US008640339B2

(12) United States Patent
Gilles et al.

(10) Patent No.: US 8,640,339 B2
(45) Date of Patent: Feb. 4, 2014

(54) BRICK MOULDING SYSTEM FOR WINDOW FRAMES AND DOOR FRAMES AND METHOD OF MANUFACTURE OF SAME

(75) Inventors: Robert Joseph Jean-Marie Gilles, Edmonton (CA); Thuy Vu, Edmonton (CA)

(73) Assignee: All Weather Windows Ltd., Edmonton (CA)

( * ) Notice: Subject to any disclaimer, the term of this patent is extended or adjusted under 35 U.S.C. 154(b) by 807 days.

(21) Appl. No.: 12/424,374

(22) Filed: Apr. 15, 2009

(65) Prior Publication Data

US 2010/0263307 A1 Oct. 21, 2010

(51) Int. Cl.
*B21D 47/00* (2006.01)

(52) U.S. Cl.
USPC ..... 29/897.31; 52/213; 52/217

(58) Field of Classification Search
USPC ..... 52/213, 217; 29/897.31
See application file for complete search history.

(56) References Cited

U.S. PATENT DOCUMENTS

| | | | | | |
|---|---|---|---|---|---|
| 1,812,822 | A | * | 6/1931 | Doering | 49/424 |
| 3,975,875 | A | | 8/1976 | Goss, Jr. | |
| 4,028,849 | A | | 6/1977 | Anderson | |
| 4,250,673 | A | | 2/1981 | Hubbard | |
| 4,272,931 | A | | 6/1981 | Stanizzo | |
| 4,694,612 | A | * | 9/1987 | Pruden et al. | 49/445 |
| 5,003,747 | A | * | 4/1991 | Morton | 52/656.5 |
| 5,042,199 | A | * | 8/1991 | Schneider et al. | 49/446 |
| 5,045,265 | A | * | 9/1991 | Pettit | 264/219 |
| 5,414,962 | A | * | 5/1995 | Forbis et al. | 49/454 |
| 5,465,539 | A | | 11/1995 | Rose | |
| 5,660,010 | A | * | 8/1997 | Sayers | 52/217 |
| 5,687,519 | A | | 11/1997 | Bruchu | |
| 5,913,786 | A | | 6/1999 | Mayer | |
| 6,055,782 | A | * | 5/2000 | Morton et al. | 52/204.1 |
| 6,385,926 | B1 | | 5/2002 | Kizar | |
| 6,427,398 | B1 | * | 8/2002 | Levine et al. | 52/204.56 |
| 6,550,210 | B1 | * | 4/2003 | Levine et al. | 52/656.5 |
| 6,807,778 | B2 | | 10/2004 | Engebretson | |
| 6,966,158 | B1 | | 11/2005 | Christensen | |
| 7,010,888 | B2 | | 3/2006 | Tumlin et al. | |
| 7,165,364 | B2 | * | 1/2007 | Inelli | 52/208 |
| 7,228,663 | B2 | | 6/2007 | Schiedegger et al. | |
| 7,246,466 | B2 | * | 7/2007 | Turner | 49/504 |
| D591,433 | S | * | 4/2009 | Campbell et al. | D25/124 |
| 2004/0200160 | A1 | * | 10/2004 | Derderian | 52/204.1 |
| 2007/0068098 | A1 | | 3/2007 | de Briere et al. | |
| 2007/0199260 | A1 | | 8/2007 | Jensen | |
| 2007/0245649 | A1 | * | 10/2007 | Habeck et al. | 52/212 |
| 2009/0199496 | A1 | * | 8/2009 | Garries et al. | 52/213 |

* cited by examiner

*Primary Examiner* — David Bryant
*Assistant Examiner* — Jacob Cigna
(74) *Attorney, Agent, or Firm* — Christensen O'Conner Johnson Kindness PLLC

(57) ABSTRACT

A method of manufacture of a brick molding system for window frames and door frames includes providing a frame member which is used to form a frame to accommodate a variety of styles of window or doors in accordance with customer requirements. The frame member has a female brick molding attachment receptacle. A plurality of brick molding variations is provided, all of which have a male coupling engageable with the female brick molding receptacle. An order is received from a customer for a selected style of frame with a selected style of brick molding. Lengths of the frame member are secured together to form the selected style of frame and in the process of forming the frame the male coupling of the selected style of brick molding is inserted into the female brick molding receptacle.

4 Claims, 22 Drawing Sheets

BRICK MOULDING SYSTEM FOR WINDOW FRAMES AND DOOR FRAMES AND METHOD OF MANUFACTURE OF SAME

FIELD

The present invention relates to a brick moulding system for window frames and door frames, which could be made from wood, polymer plastic, metal, fibreglass or composite materials.

BACKGROUND

There are various styles of brick moulding used for window frames and door frames. There are various configurations of windows required in the housing market, including: fixed, single hung, double hung, casement, awning, single and double glider and picture windows. There are various door configurations, including: slider doors, in swinging doors and out swinging doors. It is a challenge for manufacturers to provide each of the window frame configurations, door frame configurations and brick moulding styles, while ensuring that the engagement between the frame and the brick moulding will prevent air and water penetration from making their way through to the interior of building envelopes.

SUMMARY

According to one aspect there is provided a method of manufacture of a brick moulding system for window frames and door frames. A first step involves providing elongated frame members capable of being joined to form a frame having an exterior face, an interior face, an exterior disposed between the exterior face and the interior face and oriented toward the outside of the frame, and an interior disposed between the exterior face and the interior face and oriented toward the inside of the frame. The frame members have a profile which, when incorporated into a frame, includes: a brick moulding retainer extending outwardly from the exterior of the frame at the exterior face and a nailing fin extending outwardly from the exterior in spaced relation to the brick moulding retainer to define a brick moulding receptacle between the brick moulding retainer and the nailing fin. A second step involves providing a plurality of brick moulding variations, all of which have a male coupling to engage the brick moulding receptacle of the frame. A third step involves receiving an order from a customer for a selected style of frame and a selected style of brick moulding. A fourth step involves securing the elongated frame members together to form the selected style of frame and in the process of forming the frame inserting and securing the male coupling of the selected style of brick moulding into the brick moulding receptacle.

According to another aspect there is provided a brick moulding system for window frames and door frames, which includes elongated frame members formed into a frame, with the frame having an exterior face, an interior face, an exterior disposed between the exterior face and the interior face and oriented toward the outside of the frame, and an interior disposed between the exterior face and the interior face and oriented toward the inside of the frame. The frame members have a profile which includes: a brick moulding retainer extending outwardly from the exterior of the frame at the exterior face and a nailing fin extending outwardly from the exterior in spaced relation to the brick moulding retainer to define a brick moulding receptacle between the brick moulding retainer and the nailing fin. A brick moulding having a male coupling is engaged with the brick moulding receptacle.

Although beneficial results may be obtained through the use of the brick moulding system, as described above, there are additional features which may be added to further improve the performance of the brick moulding system.

It has been found that retention of the male coupling of the brick moulding within the brick moulding receptacle is improved when the brick moulding retainer and the nailing fin have inwardly oriented brick moulding engagement profiles which interlock with mating engagement profiles on an exterior of the male coupling of the brick moulding.

It has been found that the interlock is more reliable and tends to be self locating to prevent installation errors when biasing means is provided between the male coupling of the brick moulding and the brick moulding receptacle to urge the brick moulding engagement profiles into interlocking mating engagement with the engagement profiles on the exterior of the male coupling. The biasing means can take a number of forms. There will hereinafter be illustrated and described biasing means in the form of resilient members which are positioned at a remote end of the male coupling of the brick moulding, the resilient members bearing against a remote end of the brick moulding receptacle.

In order to prevent air or moisture penetration into the building envelope, it has been found that, when the frame and the brick moulding are made of a material that can be welded, such as polymer plastic or metal, there are advantages in welding the brick moulding with the frame, so that the brick moulding is integral with the frame with no gaps through which air or moisture could pass.

The preferred welding configuration is a "V" weld, as will hereinafter be further described.

The frame preferably uses a structural glaze to secure the window to the frame.

The brick moulding can be made in a wide variety of configuration, with the common aspect to each brick moulding variation being that it has a male coupling that mates with the brick moulding receptacle. As will hereinafter be further described, a brick moulding variation can be manufactured in which the brick moulding has an integral nailing fin extension. Similarly, a brick moulding variation can be made in which the brick moulding has an integral depth extension or an integral width extension.

It has been found that improved weather proofing can be obtained when seals are provided between the male coupling of the brick moulding and the brick moulding receptacle.

BRIEF DESCRIPTION OF THE DRAWINGS

The drawings are for the purpose of illustration only and are not intended to in any way limit the scope of the claims to the particular embodiment or embodiments shown, wherein:

DETAILED DESCRIPTION OF THE PREFERRED EMBODIMENT

Figure 1:
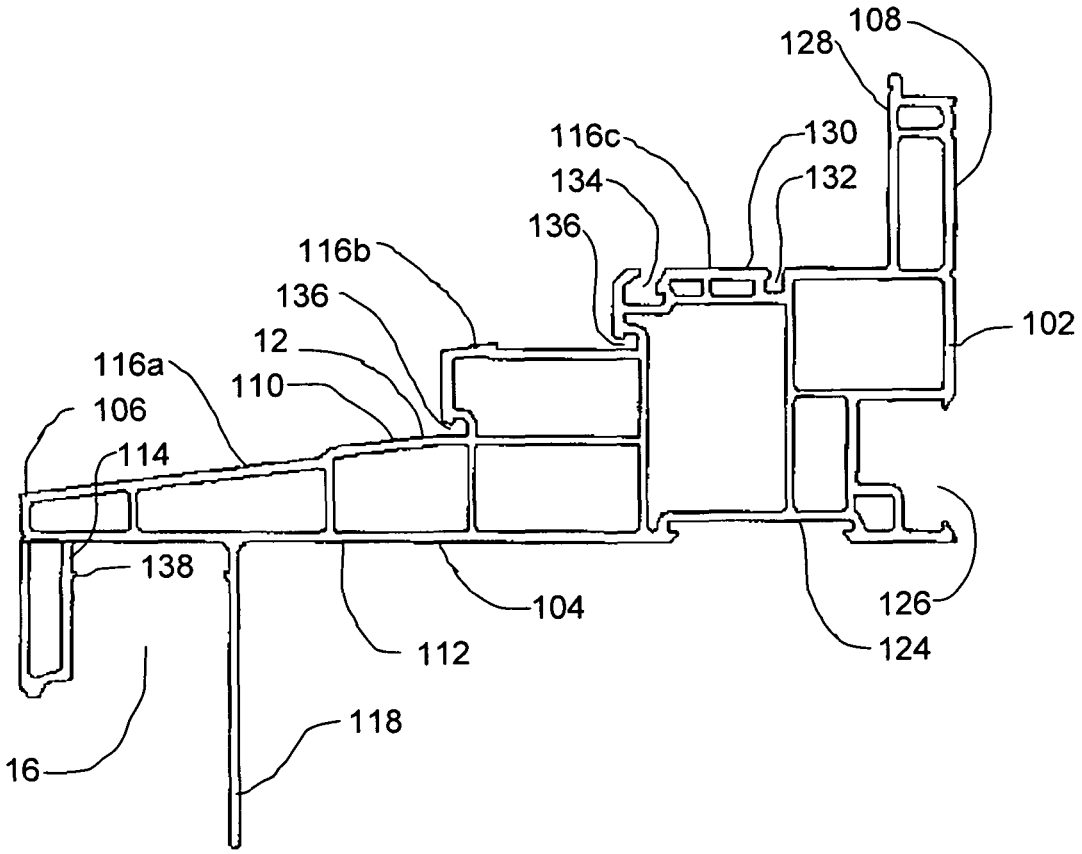
FIG. 1 is an end view in section of a frame member.

A brick moulding system for window frames and door frames, generally identified by reference numeral 10 will be described with reference to FIG. 1 through 20.

Figure 7A:
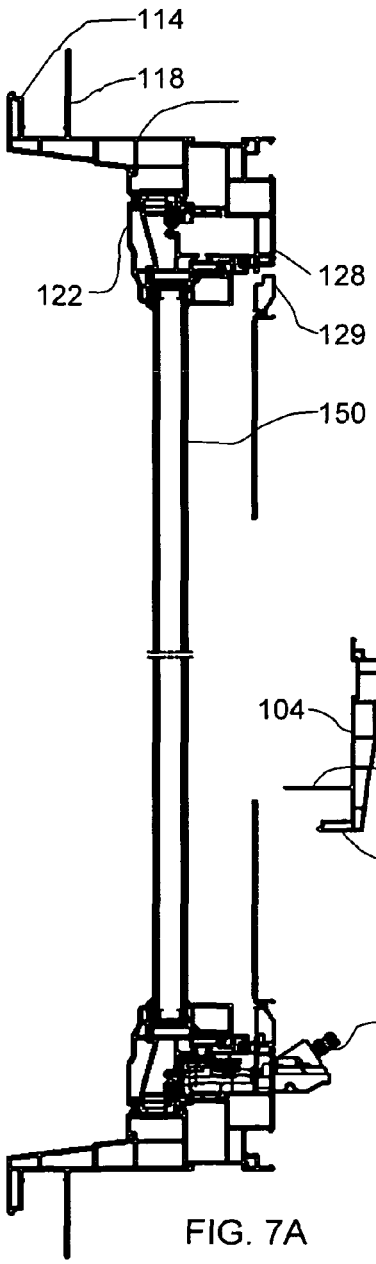
FIG. 7A is a side elevation view in section of the awning window of FIG. 7 along line A-A.
Figure 7:
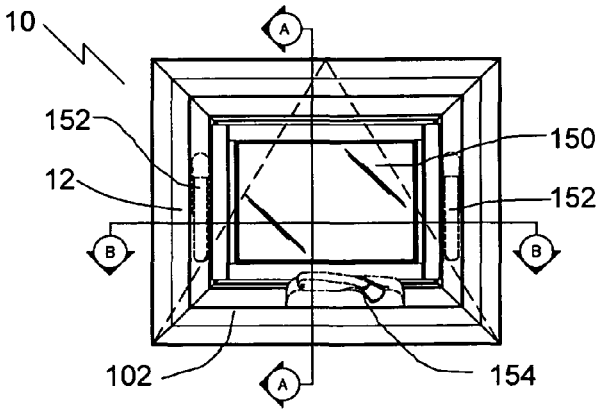
FIG. 7 is a front elevation view of an awning window with a tilting sash.
Figure 7B:
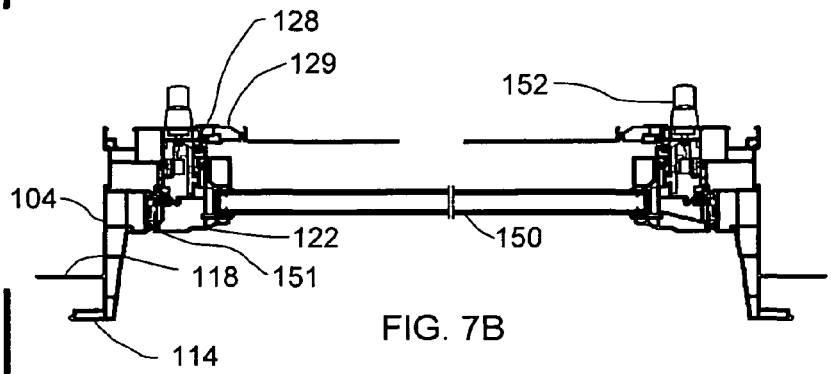
FIG. 7B is a top plan view in section of the awning window of FIG. 7 along line B-B.

Referring to FIG. 7, brick moulding system 10 includes a polymer plastic frame member 12 formed into a window frame 102. As there are many different types of windows and many different installation requirements, a large number of features have been built in to frame member 12. Illustrations of the following various window installations are provided:

FIG. 7 through 7B illustrate an awning window with a tilting sash.

Figure 8A:
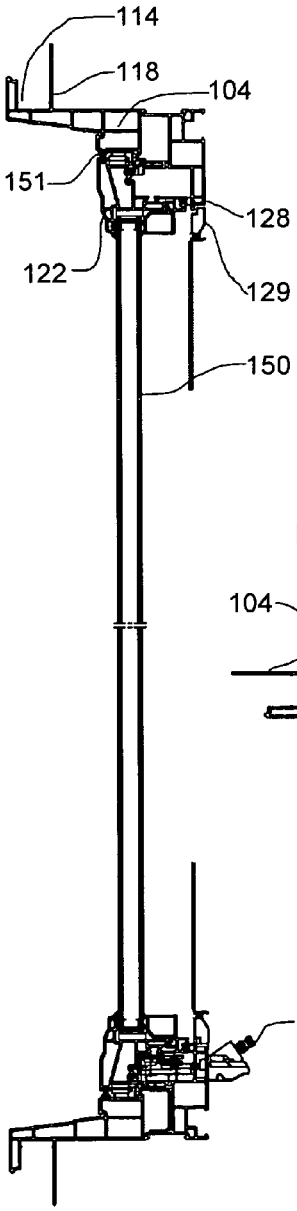
FIG. 8A is a side elevation view in section of the casement window of FIG. 8 along line A-A.
Figure 8:
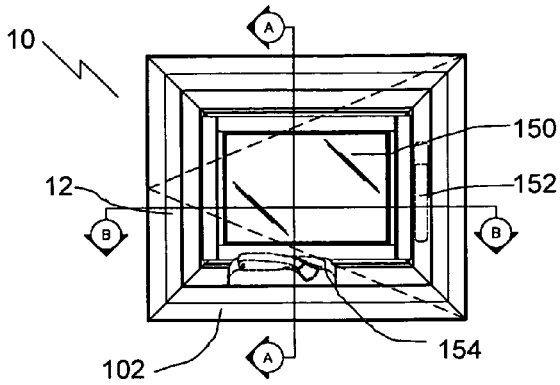
FIG. 8 is a front elevation view of a casement window with a pivoting sash.
Figure 8B:
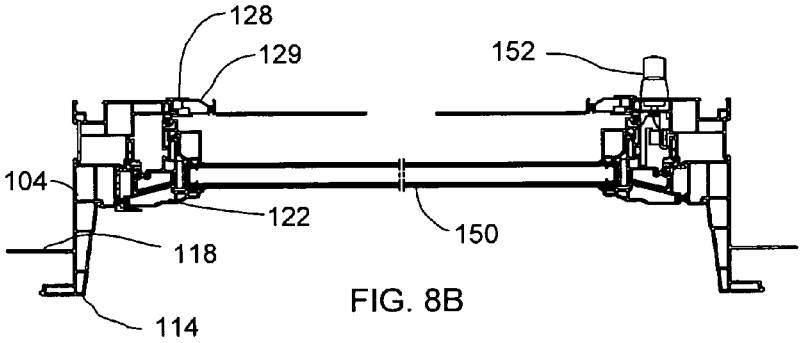
FIG. 8B is a top plan view in section of the casement window of FIG. 8 along line B-B.

FIG. 8 through 8B illustrate a casement window with a pivoting sash.

Figure 9:
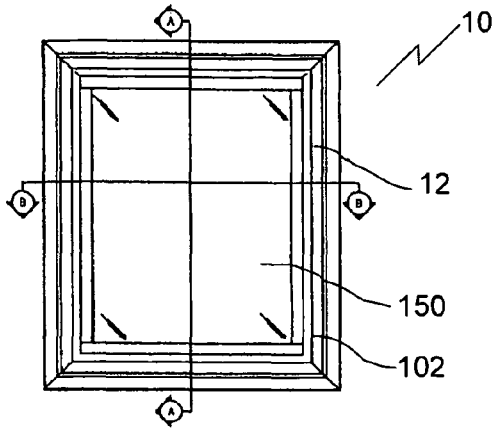
FIG. 9 is a front elevation view of a double hung fixed sash window.
Figure 9A:
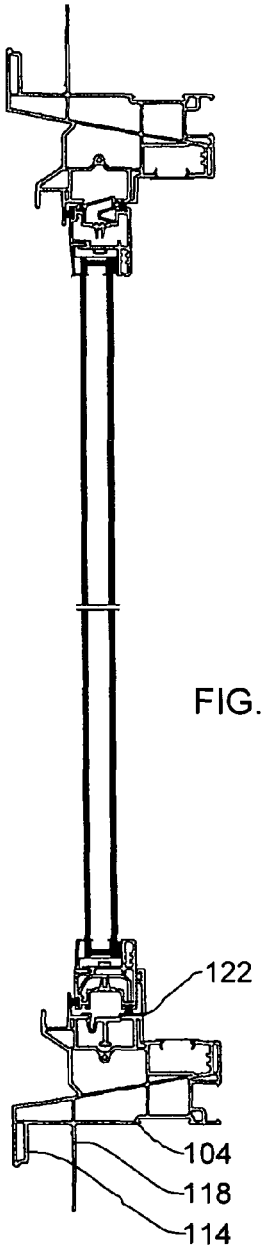
FIG. 9A is a side elevation view in section of the fixed sash window of FIG. 9 along line A-A.
Figure 9B:
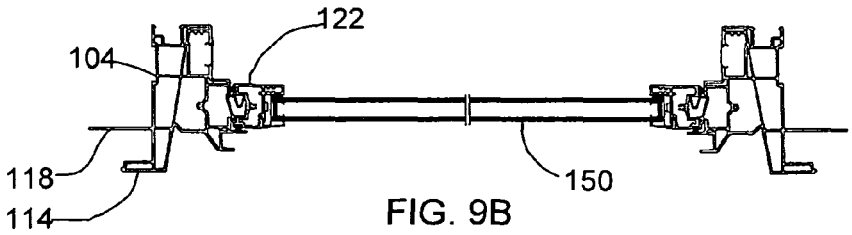
FIG. 9B is a top plan view in section of the fixed sash window of FIG. 9 along line B-B.

FIG. 9 through 9B illustrate a fixed sash double hung window.

Figure 10A:
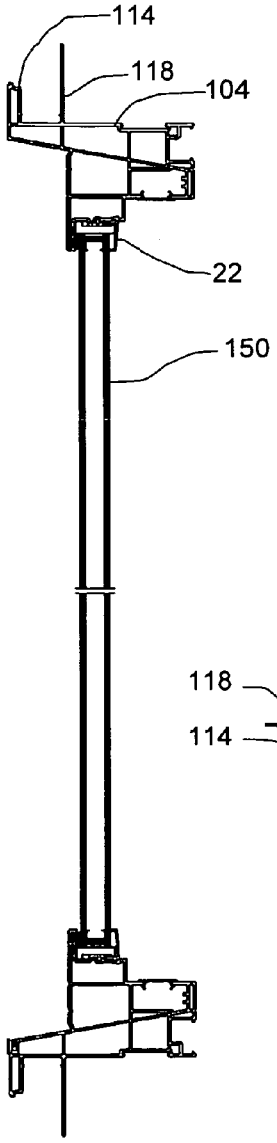
FIG. 10A is a side elevation view in section of the single hung picture window of FIG. 10 along line A-A.
Figure 10:
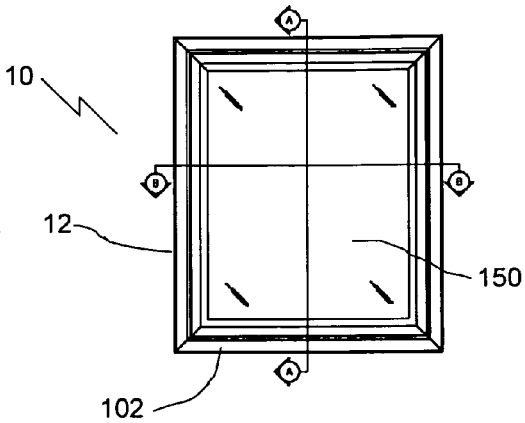
FIG. 10 is a front elevation view in section of a single hung picture window.
Figure 10B:
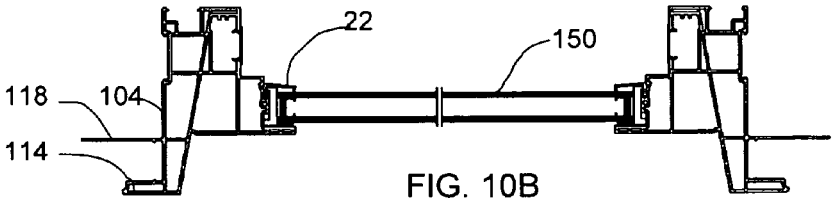
FIG. 10B is a top plan view in section of the single hung picture awning window of FIG. 10 along line B-B.

FIG. 10 through 10B illustrate a picture window.

Figure 11A:
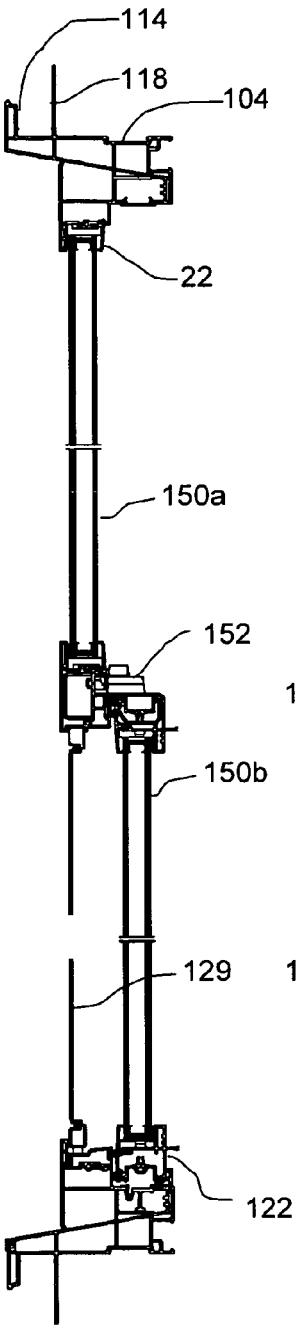
FIG. 11A is a side elevation view in section of the single hung window of FIG. 11 along line A-A.
Figure 11:
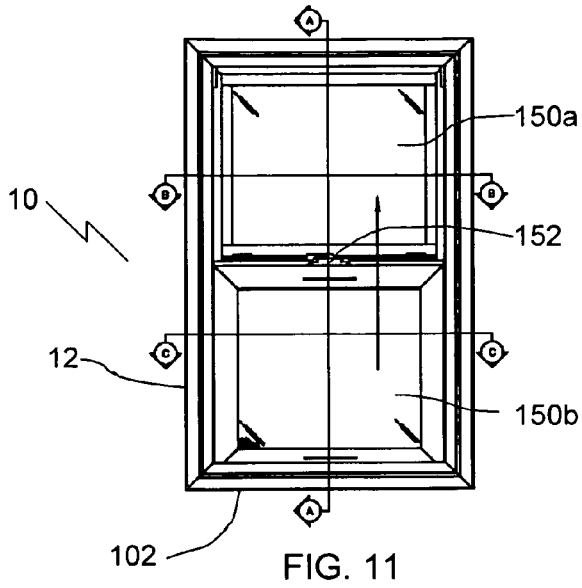
FIG. 11 is a front elevation view of a single hung window.
Figure 11B:
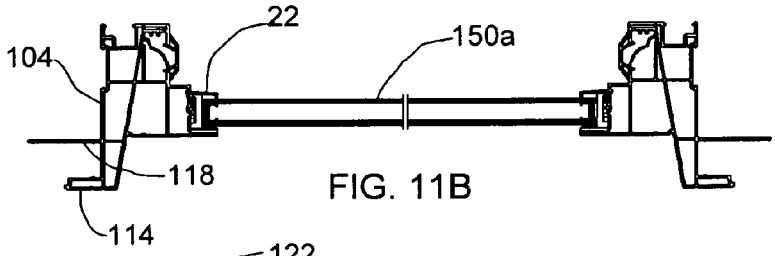
FIG. 11B is a top plan view in section of the top fixed sash of the single hung window of FIG. 11 along line B-B.
Figure 11C:
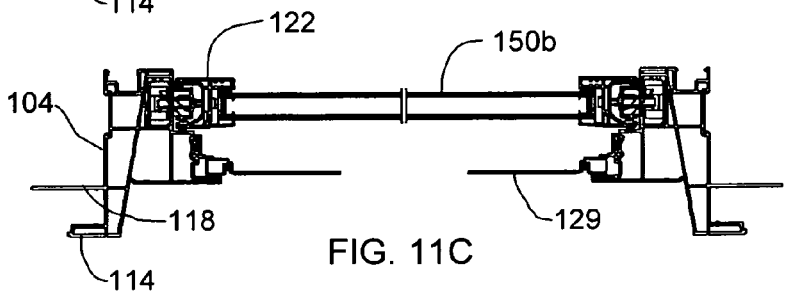
FIG. 11C is a top plan view in section of the bottom fixed sash of the single hung window of FIG. 11 along line C-C.

FIG. 11 through 11C illustrate a single hung window.

Figure 12A:
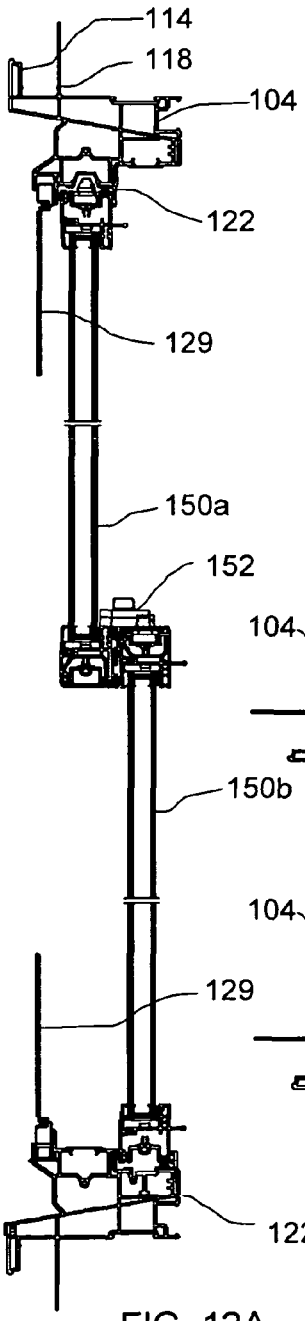
FIG. 12A is a side elevation view in section of the double hung window of FIG. 12 along line A-A.
Figure 12:
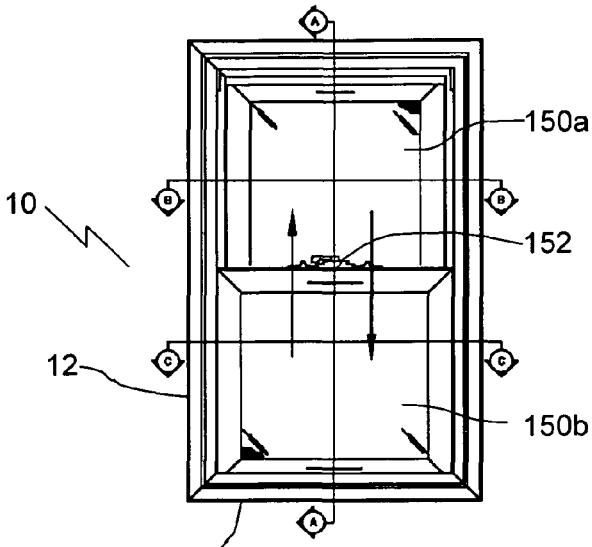
FIG. 12 is a front elevation view of a double hung window.
Figure 12B:
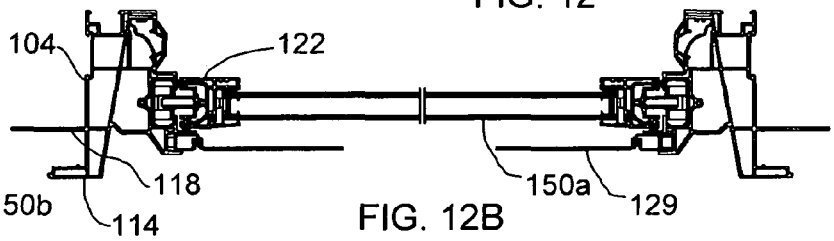
FIG. 12B is a top plan view in section of the top sash of the double hung window of FIG. 12 along line B-B.
Figure 12C:
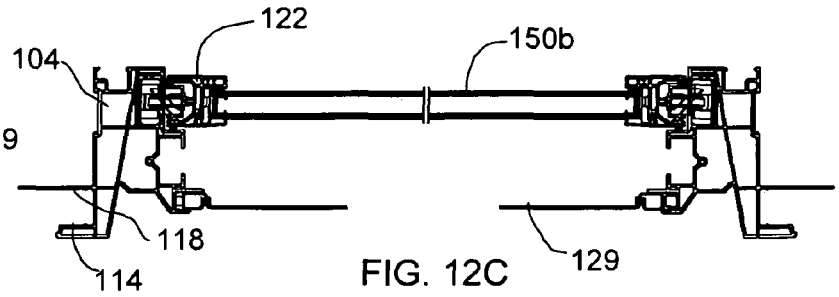
FIG. 12C is a top plan view in section of the bottom sash of the double hung window of FIG. 12 along line C-C.

FIG. 12 through 12C illustrate a double hung window.

Figure 13:
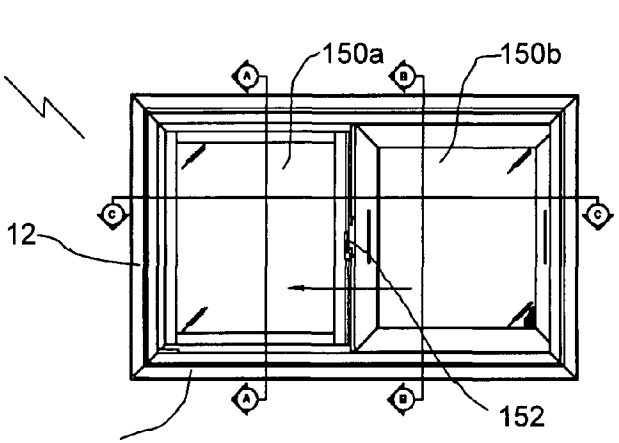
FIG. 13 is a front elevation view in section of a slider window.
Figure 13B:
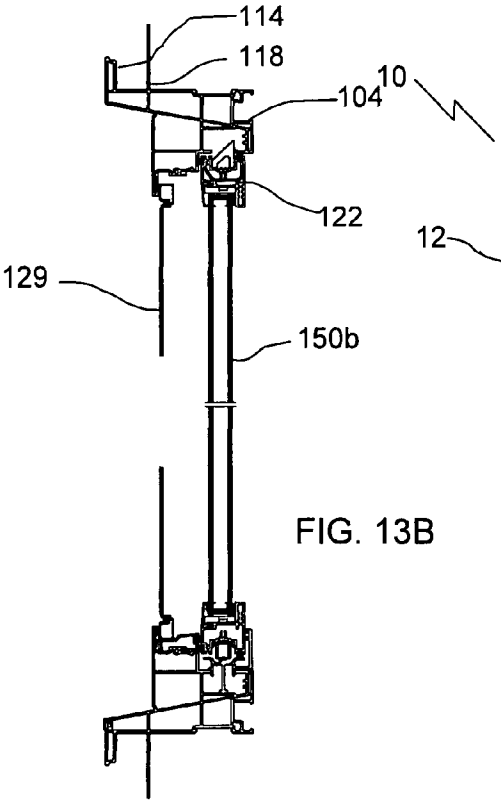
FIG. 13B is a sash side elevation view in section of the sliding sash of the slider window of FIG. 13 along line B-B.
Figure 13A:
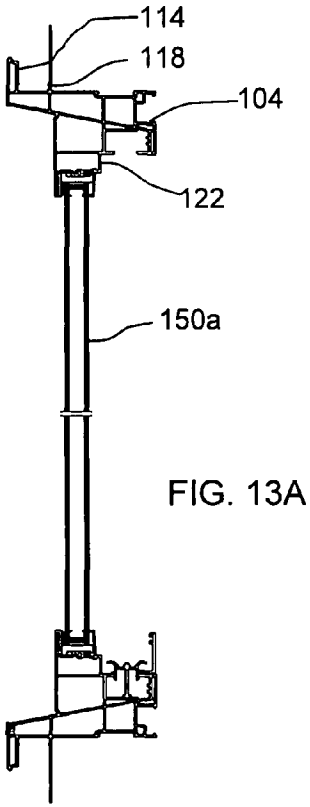
FIG. 13A is a fixed side elevation view in section of the fixed sash of the slider window of FIG. 13 along line A-A.
Figure 13C:
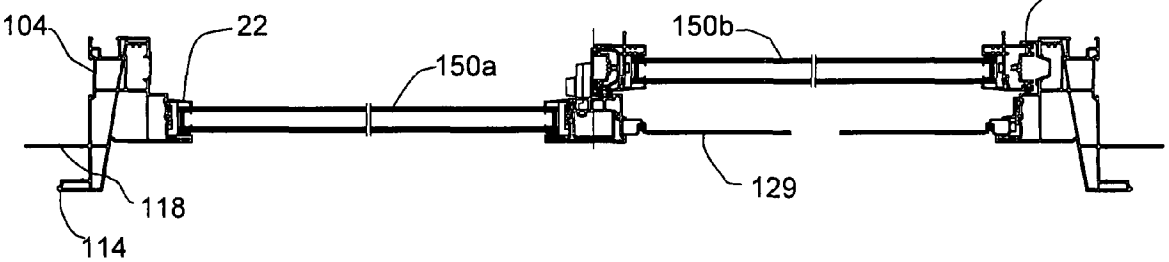
FIG. 13C is a top plan view in section of the slider window of FIG. 13 along line C-C.

FIG. 13 through 13C illustrate a slider window.

Figure 14:
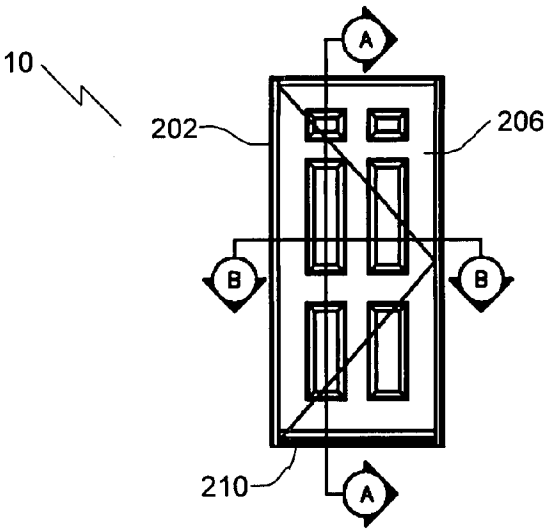
FIG. 14 is a front elevation view of an in-swing door with a frame to accommodate brick moulding.
Figure 14B:
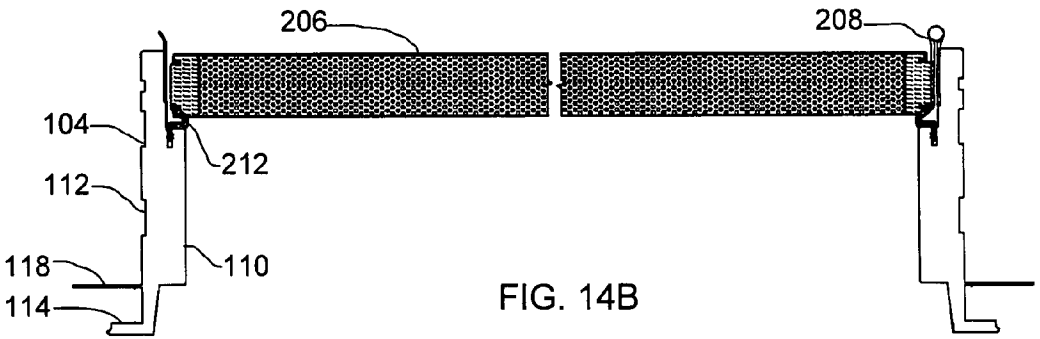
FIG. 14B is a top plan view in section of the door of FIG. 14 along line B-B.

In addition to window frames 102, brick mounding system 10 may also include polymer plastic frame members 12 formed into a door frame 202. Illustrations of the following door installations are provided:

FIG. 14 through 14B illustrate an in-swing door.

Figure 15:
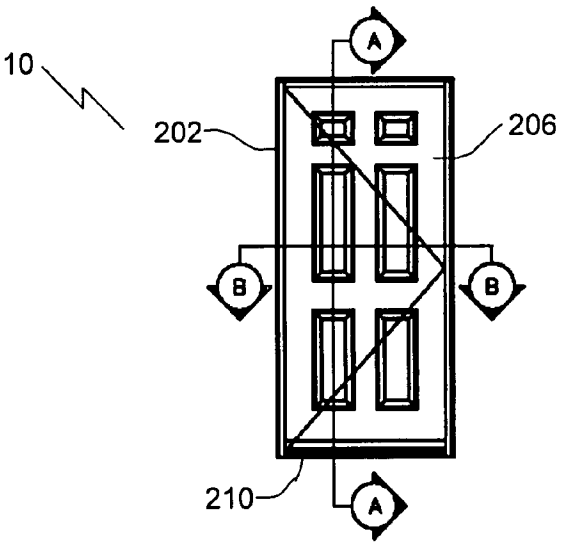
FIG. 15 is a front elevation view of an out-swing door with a frame to accommodate brick moulding.
Figure 15B:
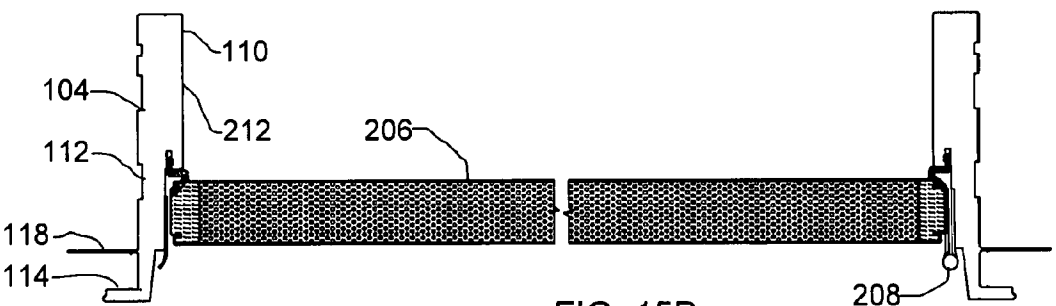
FIG. 15B is a top plan view in section of the door of FIG. 15 along line B-B.
Figure 15A:
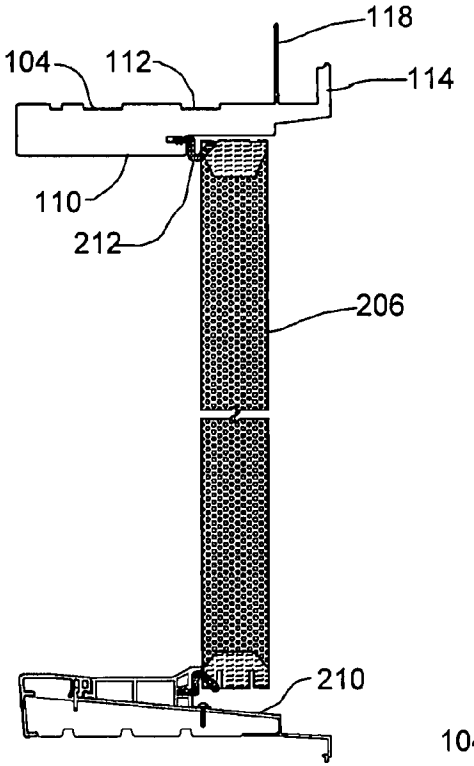
FIG. 15A is a side elevation view in section of the door of FIG. 15 along line A-A.
Figure 16B:
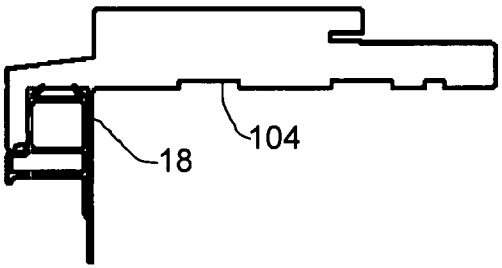
FIG. 16A through 16H are end views in section of brick moulding variations for a door frame.
Figure 16D:
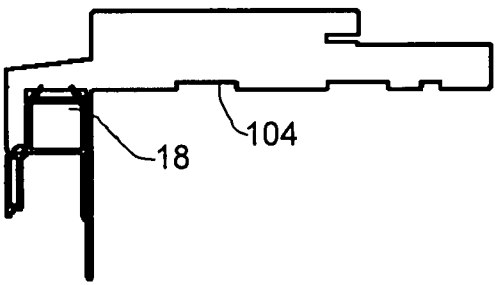
Figure 16A:
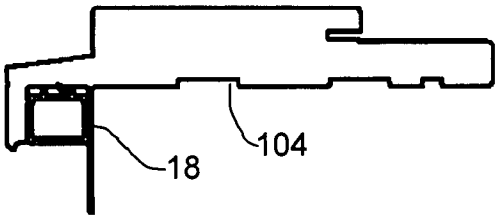
Figure 16C:
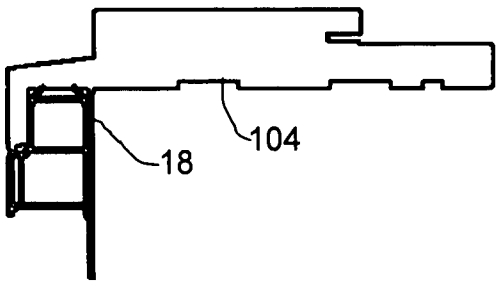
Figure 16F:
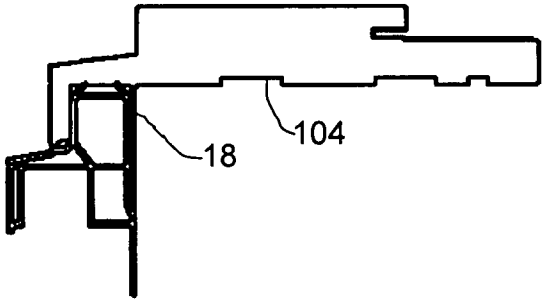
Figure 16H:
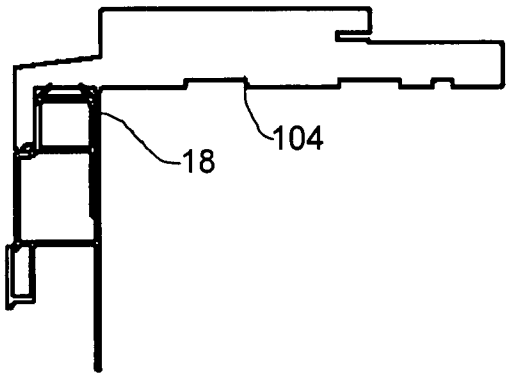
Figure 16E:
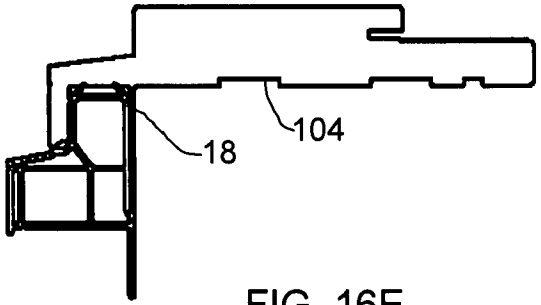
Figure 16G:
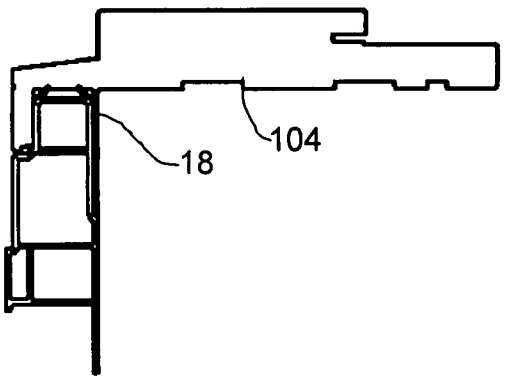

FIG. 15 through 15B illustrate an out-swing door.

Figure 17:
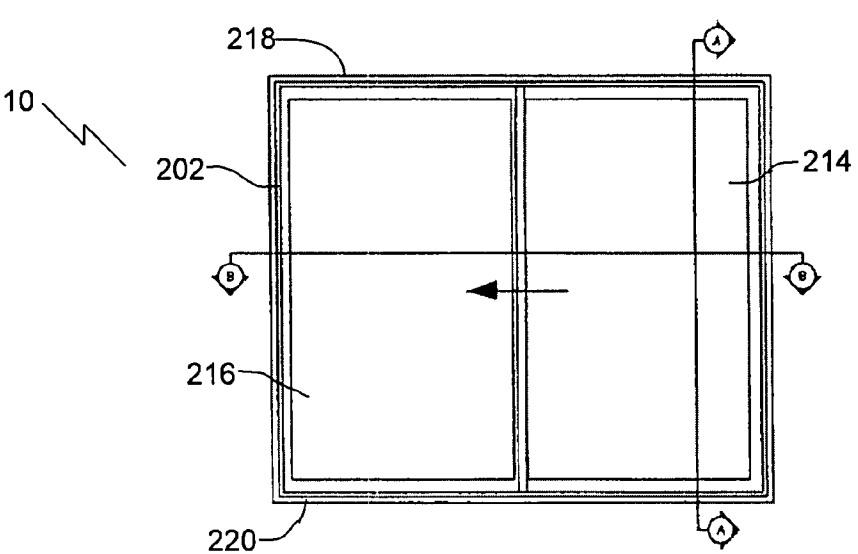
FIG. 17 is a front elevation view of a sliding door with a frame to accommodate brick moulding.
Figure 17B:
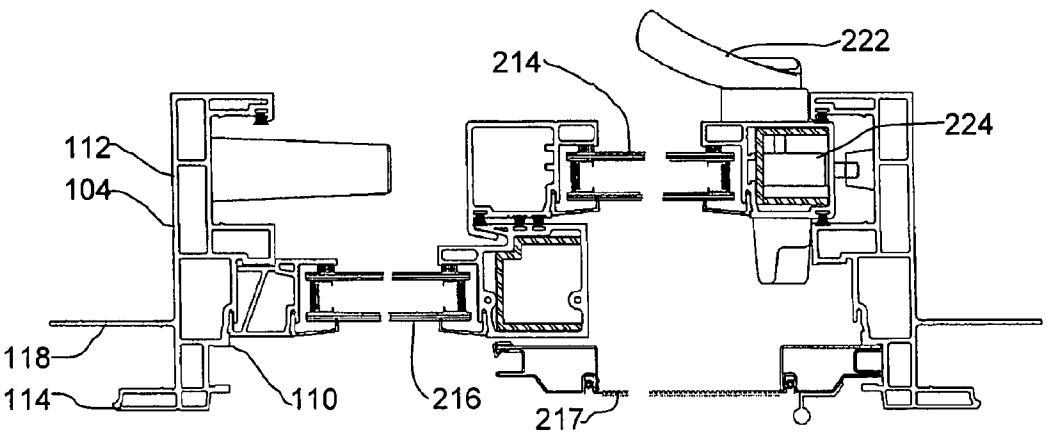
FIG. 17B is a top plan view in section of the sliding door of FIG. 17 along line B-B.

FIG. 17 through 17B illustrate a sliding door, such as a sliding patio door.

The discussion below will use the window installations as examples of various elements that may be included in brick moulding system. There will then be given a brief description of the door installations.

Figure 4:
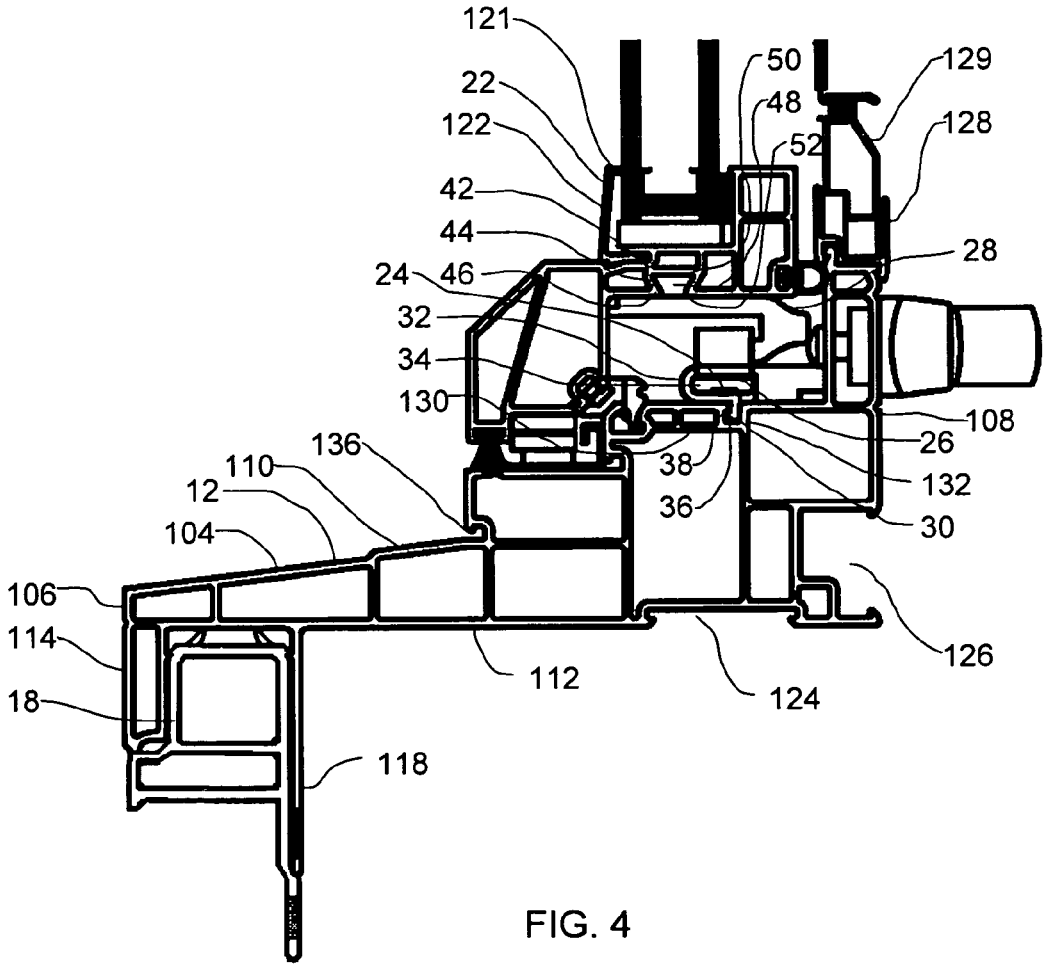
FIG. 4 is an end view in section of a frame with a movable sash.

Referring to FIG. 1, frame member 12 has a profile 104 with an exterior face 106, an interior face 108, an interior 110 disposed between interior face 108 and exterior face 106 that is oriented inwardly within a frame, such as window frame 102 shown in FIG. 7, and an exterior 112 disposed between interior face 108 and exterior face 106 that is oriented outwardly from a frame, such as window frame 102 shown in FIG. 7. A brick moulding retainer 114 depends from exterior 112 at exterior face 106. A nailing fin 118 is also provided that depends from exterior 112 in spaced relation to brick moulding retainer 114. The space between nailing fin 118 to and brick moulding retainer 114 defines a brick moulding receptacle 16 between brick moulding retainer 114 and nailing fin 118. Referring to FIG. 4, a window sash 122 is mounted within interior 110.

In addition, there are a number of features incorporated that are not used for every installation, but are useful to have available when required. Referring to FIG. 1, interior 110 has three steps 116*a*, 116*b*, and 116*c*. An installation bracket channel 124 is positioned along exterior 112 toward exterior window face 106. A jamb extension receptacle 126 is positioned in interior window face 108 toward exterior 112. A screen catch member 128 protrudes upwardly from interior 110 toward the interior window face 108 of profile 104. Referring to FIG. 4, screen catch member 128 is used to hold a screen system 129. As can be seen in FIGS. 7A and 7B, screen system 129 is held on two sides by screen catch members 128. Referring to FIG. 1, a tie bar seat 130 is positioned on third step 116*c* of interior 110 and toward interior window face 108 of profile 104. Tie bar seat 130 has a tie bar guide 132. A weather stripping engagement channel 134 is positioned along third step 116*c* of interior 110 of profile 104. Glazing bead engagement channels 134 and 136 are positioned on interior 110 of profile 104, underlying second step 116*b* and third step 116*c*.

Referring to FIG. 7 through 7B, a window 150 is installed as an awning window such that, by unlocking locks 152 and rotating handle 154, awning window 150 is opened. In this embodiment, sash 122 is hinged to profile 104, and permits window 150 and its casing to pivot outward about a horizontal axis provided by hinge 151 about the top of frame 102.

Referring to FIG. 8 through 8B, a window 150 is installed as casement window such that, by unlocking lock 152 and rotating handle 154, casement window 150 is opened by pivoting outwardly along a vertical axis provided by hinge 151. In this embodiment, sash 122 is hinged to profile 104, and permits window 150 to pivot within frame 102.

Referring to FIG. 9 through 9B, a window 150 is installed as a fixed sash double hung window, with sash 122 being separate from and attached to profile 104. As window 150 is not intended to move there is no need for a screen or for locking and opening mechanisms.

Figure 20:
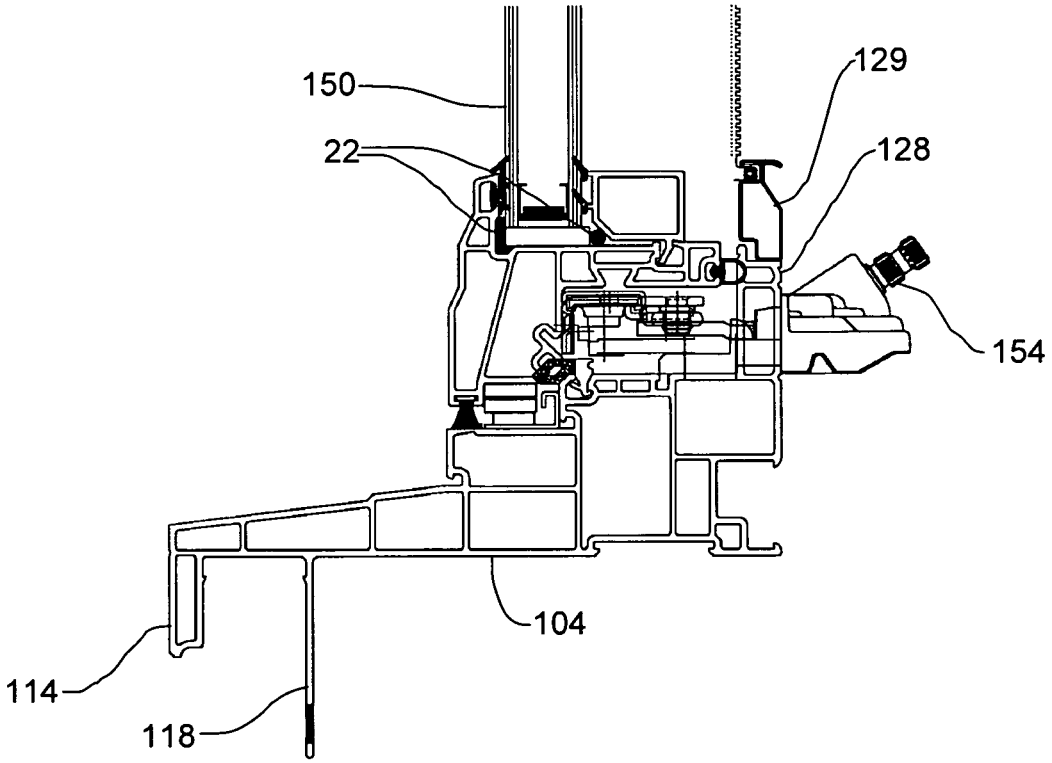
FIG. 20 is a detailed side elevation view in section showing the structural glazing.

Referring to FIG. 10 through 10B, a window 150 is installed as a single hung picture window, with a glazing bead 22 attached to profile 104. Referring to FIG. 20, glazing 22 is preferably installed on the inside and outside of window 15. As window 150 is not intended to move there is no need for a screen or for locking and opening mechanisms.

Referring to FIG. 11 through 11C, windows 150*a* and 150*b* are installed in a single hung window arrangement. Window 150*a* is fixed in place, while window 150*b* is able to slide vertically. A lock 152 is provided to keep window 150*b* in the lower position when desired. In this embodiment, glazing bead 22 of window 150*a* is attached to profile 104 of frame member 12 as can be seen in FIG. 11B, while frame member 12 with respect to movable window 150*b* is a separate component that permits the sides of window 150*b* to slide vertically as can be seen in FIG. 11C.

Referring to FIG. 12 through 12C, windows 150*a* and 150*b* are installed in a double hung window arrangement. Both windows 150*a* and 150*b* are able to slide vertically. A lock 152 is provided to lock windows 150*a* and 150*b* in their closed positions, with window 150*a* on top and window 150*b* on bottom.

Referring to FIG. 13 through 13C, windows 150*a* and 150*b* are installed in a slider window configuration. Window 150*a* is fixed and is installed with a glazing bead 22, while window 150*b* is installed with a movable sash 122.

The frame member 12 is intended to be used in combination with a brick moulding 18 having a male coupling 20 which engages brick moulding receptacle 16, as shown in FIG. 4. FIG. 3A through 3H illustrates various brick moulding options.

Figure 2:
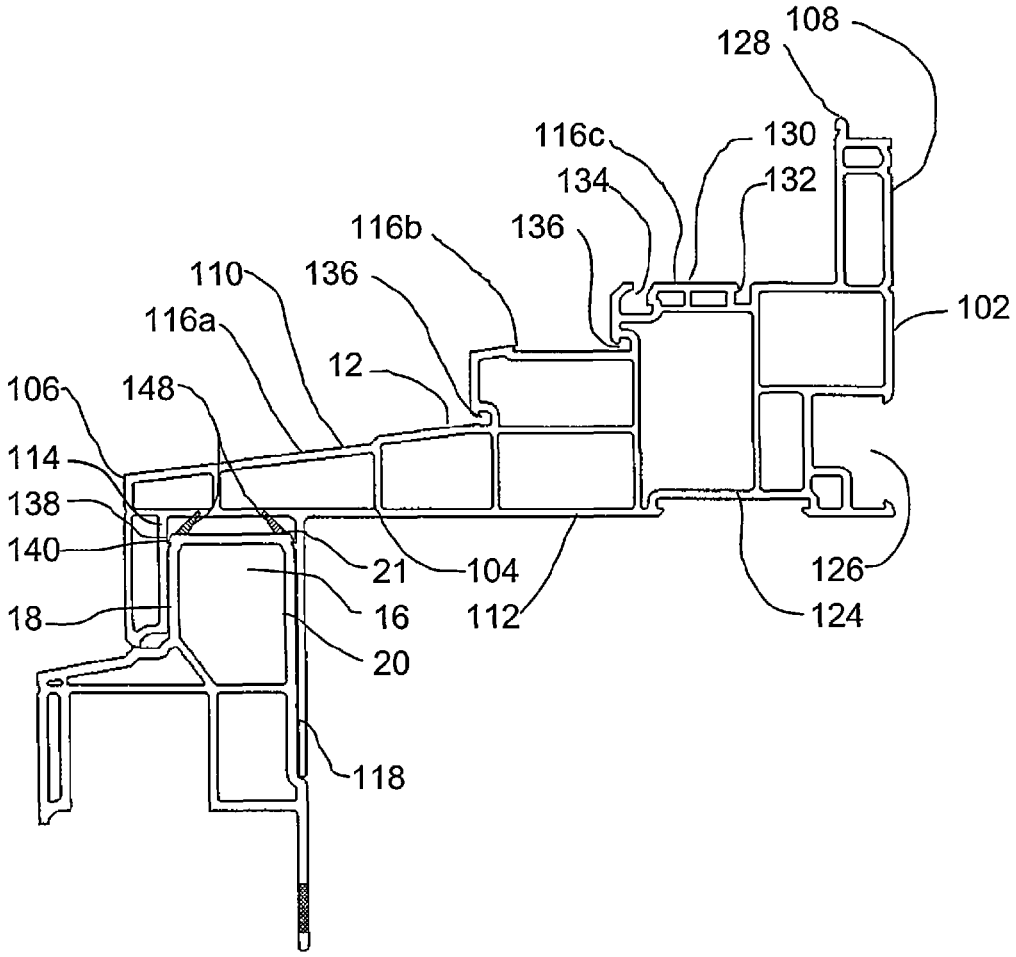
FIG. 2 is an end view in section of a frame member with a brick moulding attached.

Referring to FIG. 2, brick moulding retainer 114 and nailing fin 118 have a first portion 138 of a two portion locking engagement profile that is oriented inwardly into brick moulding receptacle 16, and the male coupling 20 of brick moulding 18 has a second portion 140 of a two portion locking engagement profile oriented outwardly to engage first portion 138.

Figure 3A:
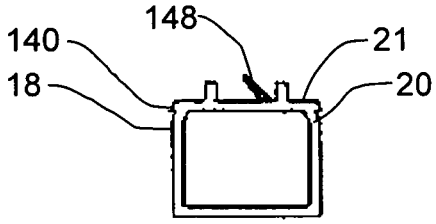
FIG. 3A through 3H are end views in section of brick moulding variations.

The following features will be noted in the illustrated embodiments of brick moulding variations. Referring to FIG. 3B through 3H, brick moulding 18 may have an integral nailing fin extension 144. Referring to FIG. 3F, brick moulding 18 may have an integral width extension 146. Referring to FIG. 3G, brick moulding 18 may have an integral depth extension 147. Referring to FIG. 3H, brick moulding 18 may have both an integral with extension 146 and an integral depth extension 147. Referring to FIG. 3A through 3H, it is preferred that resilient members 148 be positioned at a remote end 21 of male coupling 20. Resilient members 148 serve as biasing means between male coupling 20 of brick moulding 18 and brick moulding receptacle 16 to bias the two part locking engagement 138 and 140 in locking engagement. Each of the brick moulding variations in FIG. 3A through 3H are intended for particular applications:

FIG. 3A—brick moulding for brick applications

Figure 3B:
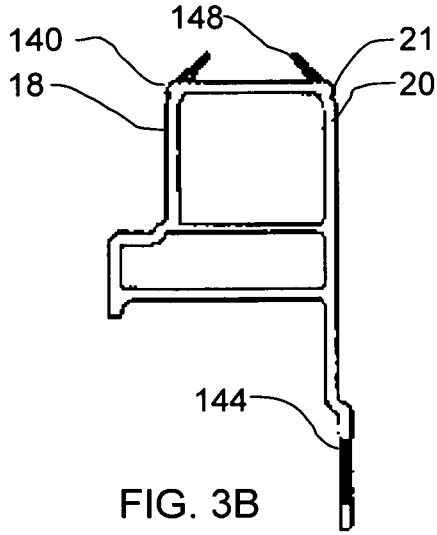
Figure 3C:
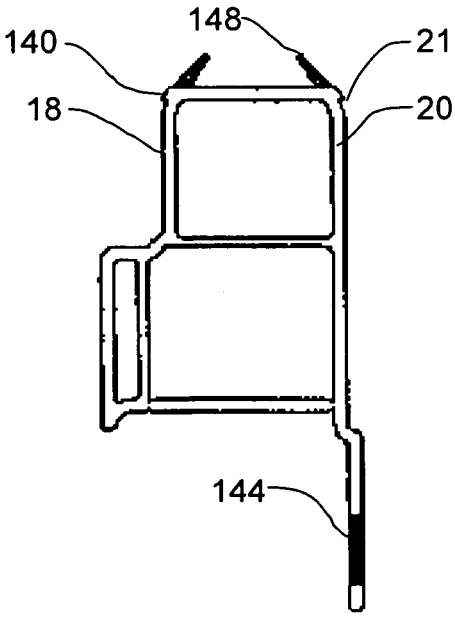
Figure 3D:
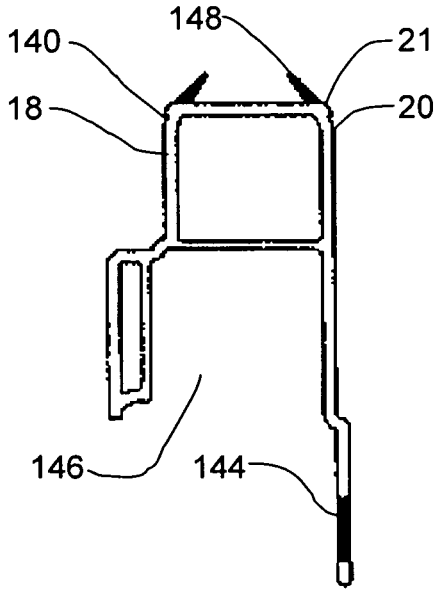
Figure 3E:
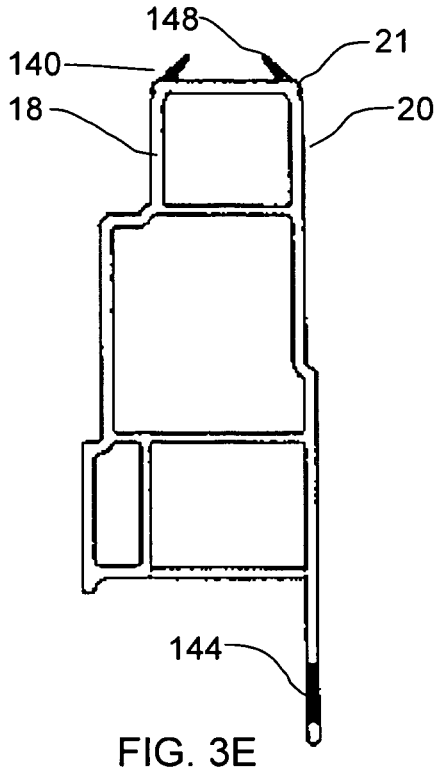
Figure 3F:
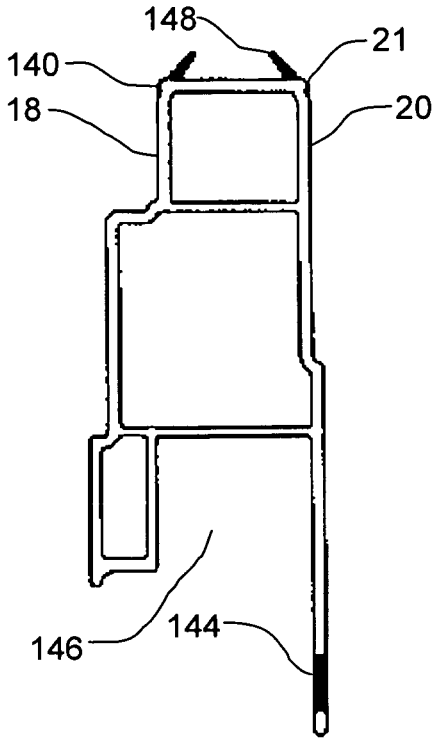
Figure 3G:
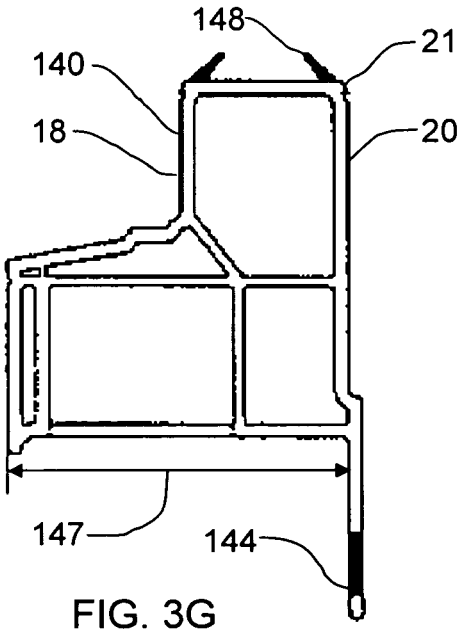
Figure 3H:
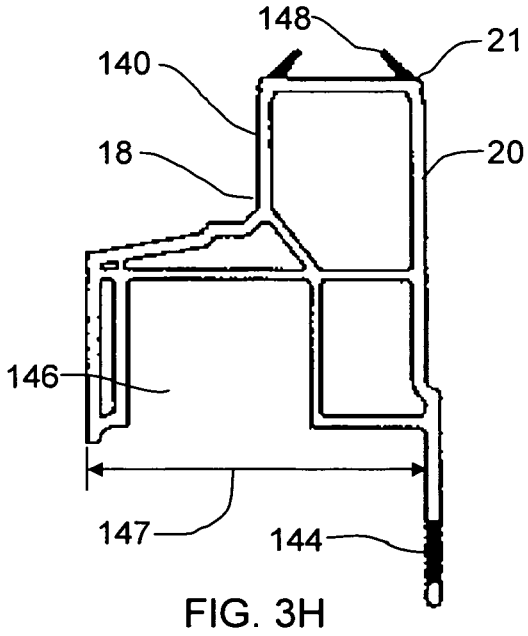

FIG. 3B—brick moulding for brick applications with a first increased width;

FIG. 3C—brick moulding for brick applications with a greater second increased width;

FIG. 3D—brick moulding for stucco or siding applications;

FIG. 3E—brick moulding for brick applications with an even greater third increased width;

FIG. 3F—brick moulding for stucco or siding applications with a first increased width;

FIG. 3G—brick moulding for brick applications with an increased depth. This would be used as part of rainscreen building requirements in exposures receiving large amounts of rainfall; and FIG. 3H—brick moulding for stucco or siding applications having both increased width and increased depth.

A method of manufacturing the brick moulding system for window frames, as described above, will be described with reference to FIG. 1 through 6.

Referring to FIG. 1, a first step involves providing a frame member 12 which is used to form a frame to accommodate a variety of styles of windows in accordance with customer requirements. Frame member 12 can be made out of any suitable material, such as wood, a polymer plastic extrusion or an extrusion made from aluminium or another metal. Other suitable materials include fibreglass pultrusions or other composite pultrusions. Frame member 12 has a female brick moulding attachment receptacle 16. Referring to FIG. 3A through 3H, a plurality of brick moulding variations 18 are provided, all of which have a male coupling 20 this engages female brick moulding receptacle 16, as shown in FIG. 2. Variations are shown in FIG. 3A through 3H. As can be seen, brick moulding variations 18 vary by size and shape. Other sizes and shapes may also be developed.

When an order is received from a customer for a selected style of frame with a selected style of brick moulding, lengths of frame member 12 are secured together to form the selected style of window frame 102. In the process of forming the window frame 102, male couplings 20 of the selected style of brick moulding 18 are inserted into female brick moulding receptacle 16. The preferred manner of securing is by welding. With polymer plastic materials, this involves plastic welding. Brick moulding 18 is welded so that brick moulding 18 is integral with window frame 102 with no gaps through which air or moisture could pass.

Referring to FIG. 4, if the selected style of frame has a sash 122 that is a separate component, such as a movable portion 122, there may be an additional step of providing a tie bar guide 24 in polymer plastic frame member 12 to accommodate in snap fit or sliding fit relation a tie bar 32 which interacts with a lock keeper 28 on movable portion 122 to secure movable portion 122 against movement. A preferred configuration for tie bar guide 24 is a channel. Tie bar 32 is engaged with tie bar guide 24. In other embodiments, sash 122 may be a separate but fixed component, as shown for example in FIGS. 9A and 9B.

Figure 5:
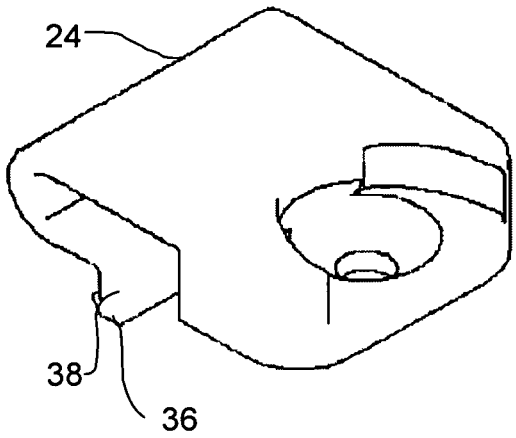
FIG. 5 is a perspective view of a tie bar guide.

Referring to FIG. 4, when tie bar guide 24 is in the form of a channel 132, channel 132 preferably has a channel opening 30 that is narrower than channel 132. In such a case, a tie bar 32, shown in FIG. 5, is provided that has a channel engagement member 34 with an enlarged remote end 36 supported by a relatively narrow neck 38. Channel engagement member 34 is slid into position by insertion into one end of tie bar guide 24 with neck portion 38 extending through channel opening 30. Tie bar 32 is maintained in a selected axial position along channel 132 by a fastener (not shown).

Figure 6:
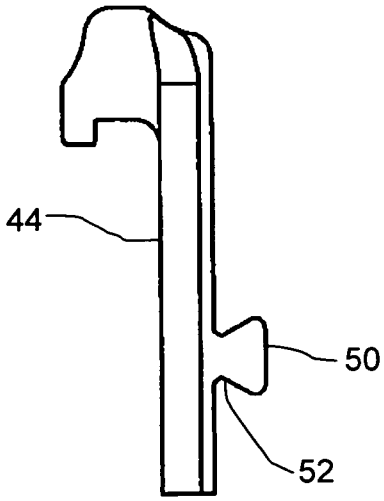
FIG. 6 is a perspective view of a lock keeper.

When movable components are used, a lock keeper channel 42 may be provided in sash 122 to accommodate a lock keeper 44, shown in FIG. 6, which interacts with tie bar 32 on first frame member 12 to secure sash 122 against movement. Lock keeper 44 is engaged with lock keeper channel 42 in a snap fit relation. In this alternative, lock keeper channel 42 may have a channel opening 46 that is narrower than lock keeper channel 42. Lock keeper 44 has a channel engagement member 48 with an enlarged remote end 50 supported by a relatively narrow neck 52. Channel engagement member 48 is slid into position by insertion into one end of lock keeper channel 42, with neck portion 52 extending through channel opening 46. Lock keeper 44 is maintained in a selected axial position along channel 42 by a fastener (not shown).

The above description with respect to FIG. 4 to 6 is an example of how sash 122 may be attached to profile 104. These steps may not be necessary when sash 122 is integrally formed with profile 104. Furthermore, only some of the connections may be necessary when a window is not movable. Finally, the actual method of attachment or the form of sash 122 may vary, extends outwardly on whether that particular side of the window is intended to slide or swing out.

Figure 14A:
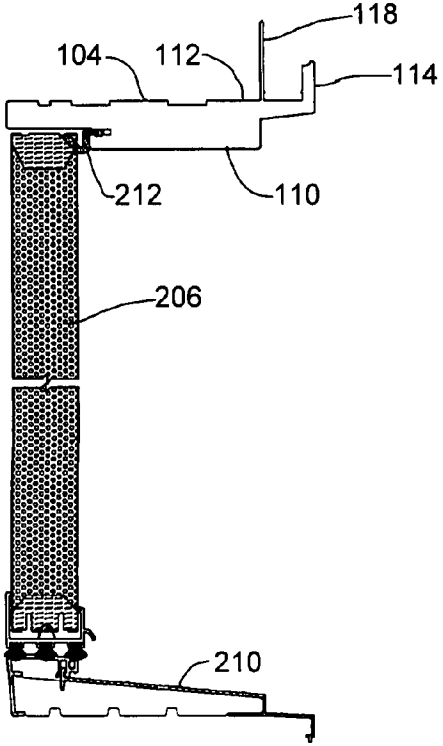
FIG. 14A is a side elevation view in section of the door of FIG. 14 along line A-A.

There will now be given a description of how the above principles may be applied to a door frame 202. Referring to FIG. 14, door frame 202 has a door 206 that swings inward on hinges 208. Referring to FIG. 14A, frame 202 includes a threshold 210. Referring to FIGS. 14A and 14B, other components of frame 202 are similar to those in window frame 102 described above, including used with the window installations, including profile 104 with, interior 110 oriented inwardly within window frame 102, exterior 112 oriented outwardly from window frame 102, moulding retainer 114, nailing fin 118. Door installation 202 also includes weatherstripping 212 to seal door 206 to frame 204 when closed.

Referring to FIG. 15 through 15B, door frame 202 is designed to accommodate a door that swings outward on hinges 208 rather than inward, and is otherwise similar to that shown in FIG. 14 through 14B.

FIG. 16A through 16H show the various brick moulding designs 18 discussed in FIG. 3A through 3H above with door frame 202 for an in-swing door shown in FIG. 14 through 14B as an example. Installation will be similar for an out-swing door shown in FIG. 15 through 15B.

Figure 17A:
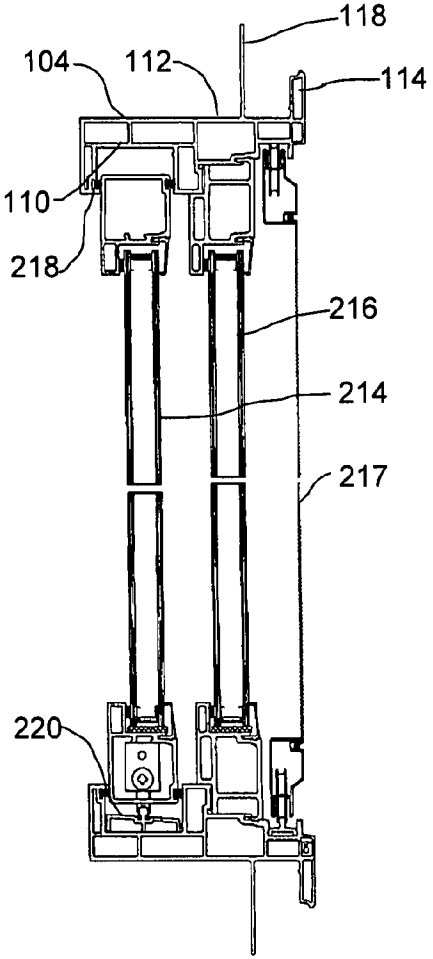
FIG. 17A is a side elevation view in section of the sliding door of FIG. 17 along line A-A.
Figure 18A:
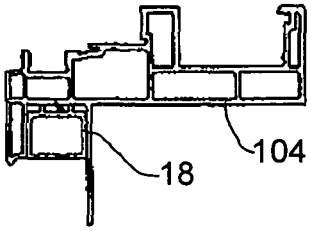
FIG. 18A through 18H are end views in section of brick moulding variations for a door frame.
Figure 18B:
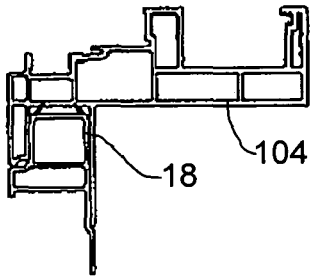
Figure 18C:
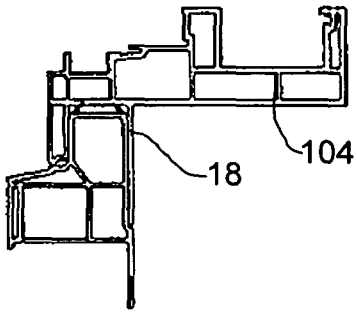
Figure 18D:
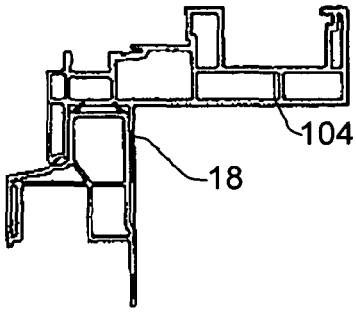
Figure 18E:
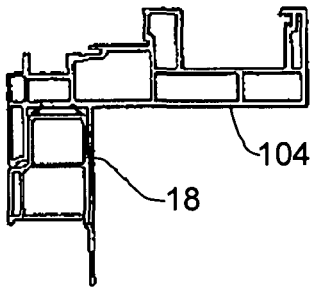
Figure 18F:
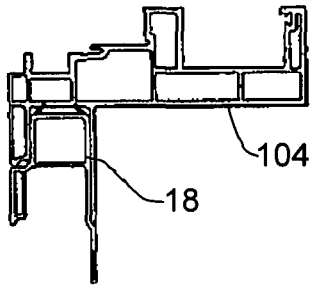
Figure 18G:
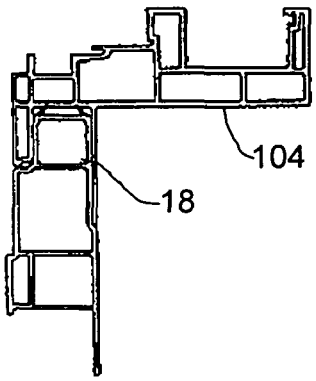
Figure 18H:
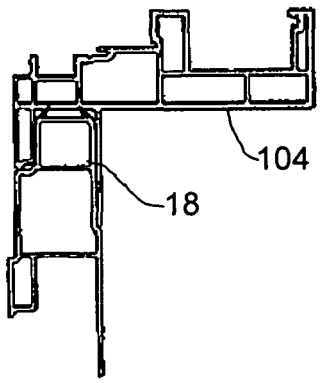

Referring to FIG. 17 through 17B door frame 202 is designed to accommodate a sliding door 214, a fixed door 216 and a screen 217. Referring to FIG. 17A, door frame 202 has a top track guide 218 and a bottom track guide 220. Doors 214 and 216 are made from windows with fixed or movable sashes. Referring to FIG. 17B, sliding door 214 has a handle 222 and a lock 224. FIG. 18A through 18H show the various brick moulding designs 18 discussed in FIG. 3A through 3H above with a sliding door frame.

Figure 19:
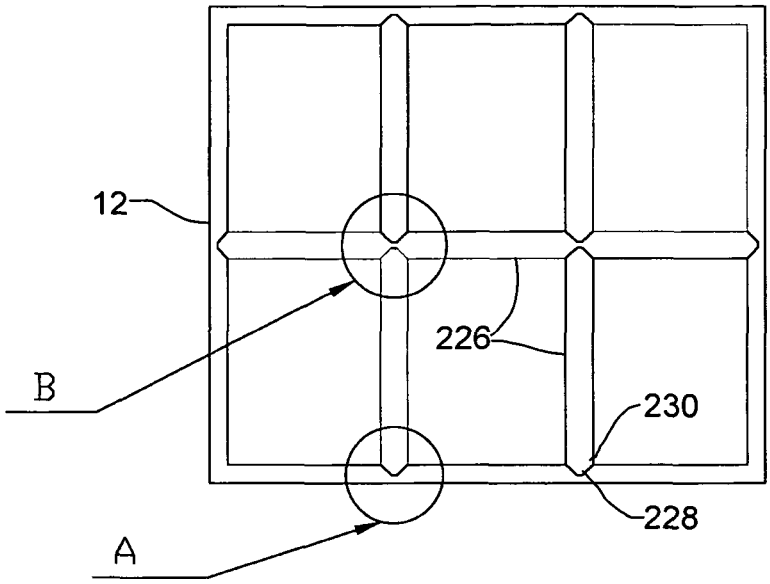
FIG. 19 is a front elevation view of mullions welded to a frame.
Figure 19A:
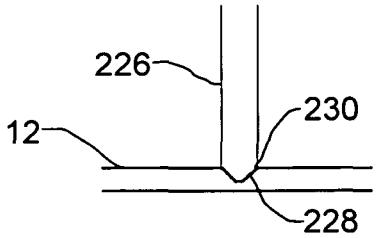
FIG. 19A is a detailed front elevation view of detail A on FIG. 19 showing a mullion welded to the frame.
Figure 19B:
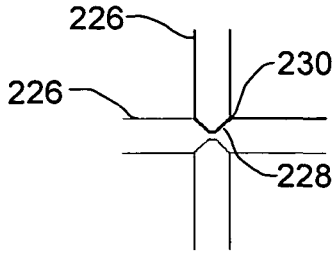
FIG. 19B is a detailed front elevation view of detail B on FIG. 19 showing mullions welded together.

Referring to FIG. 19 through 19B, mullions 226 may be incorporated into frame 12, such as a window frame, by cutting V-grooves 228 and corresponding V-shaped end 230. V-shaped end 230 is then welded into V-groove 228. FIG. 19A shows the details of a mullion 226 being welded to frame 12, and FIG. 19B shows the details of mullions 226 being welded to other mullions 226. While other profiles other than a V-shape may be used, this shape is preferred. With mechanically fastened mullions, there is generally a high failure rate, and leakage between concepts can occur if mullions 226 are used to divide the window into separate openings. This failure rate is reduced significantly by welding mullions 226 together or to frame 102.

Glazing bead 22 as discussed above and shown in FIG. 20 is intended to be a structural glazing, which more fully bonds the glass to the frame, such that the strength of the glass works with the strength of the frame to enhance strength and stability. This can be compared with the prior art, which uses gaskets or tape, for example, that seal the window but provide little structural support.

In this patent document, the word "comprising" is used in its non-limiting sense to mean that items following the word are included, but items not specifically mentioned are not excluded. A reference to an element by the indefinite article "a" does not exclude the possibility that more than one of the element is present, unless the context clearly requires that there be one and only one of the elements.

It will be apparent to one skilled in the art that modifications may be made to the illustrated embodiment without departing from what is claimed.

What is claimed is:

1. A method of manufacture of a brick moulding system, comprising:

providing elongated frame members formed from hollow extrusions capable of being joined to form a frame having an exterior face, an interior face, an exterior disposed between the exterior face and the interior face and oriented toward the outside of the frame, an interior disposed between the exterior face and the interior face and oriented toward the inside of the frame, the frame members having a profile which, when incorporated into the frame, includes:

a female brick moulding retainer extending outwardly from the exterior of the frame at the exterior face, wherein positioned within the brick moulding retainer is a first part of a two-part locking engagement profile; and a nailing fin extending outwardly from the exterior in spaced relation to the brick moulding retainer to define a single brick moulding receptacle between the brick moulding retainer and the nailing fin;

providing a plurality of brick moulding variations, all of which have a male coupling formed from a hollow extrusion to engage the brick moulding receptacle and a nailing fin extension, wherein positioned on the male coupling is a second part of the two-part locking engagement profile, and wherein resilient members are positioned at a remote end of the male coupling;

receiving an order from a customer for a selected style of frame and a selected style of brick moulding; and securing the elongated frame members together to form the selected style of frame and in the process of forming the frame inserting the male coupling of the selected style of brick moulding into the brick moulding receptacle to bring the two-part locking engagement profile into engagement and welding the male coupling of the brick moulding within the brick moulding receptacle of the frame so that the brick moulding is integral with the frame with the locking engagement profile resilient members forming a seal the locking engagement profile resilient members forming a seal to prevent air or moisture penetration.

2. The method of claim 1, including a step of positioning a window sash within the interior of the frame.

3. The method of claim 1, the frame members having a profile with a tie bar guide on the interior of the frame and the method including a step of snapping or sliding a tie bar into the tie bar guide.

4. The method of claim 2, the frame members having a profile with a lock keeper receiver on the window sash and the method including a step of snapping or sliding a lock keeper into place.

* * * * *